US009433259B2

(12) United States Patent
Jacobsen

(10) Patent No.: US 9,433,259 B2
(45) Date of Patent: Sep. 6, 2016

(54) SELF-ACTUATING WEBBING ADJUSTER AND HELMET STRAP SYSTEM INCLUDING SAME

(71) Applicant: Bell Sports, Inc., Scotts Valley, CA (US)

(72) Inventor: Gregg Jacobsen, Scotts Valley, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 219 days.

(21) Appl. No.: 14/061,795

(22) Filed: Oct. 24, 2013

(65) Prior Publication Data

US 2015/0113710 A1 Apr. 30, 2015

(51) Int. Cl.

*A44B 11/12* (2006.01)
*A44B 11/10* (2006.01)
*A42B 3/08* (2006.01)

(52) U.S. Cl.

CPC ..... *A44B 11/125* (2013.01); *A42B 3/08* (2013.01); *A44B 11/10* (2013.01); *Y10T 24/2185* (2015.01); *Y10T 24/4019* (2015.01); *Y10T 24/4084* (2015.01); *Y10T 24/4086* (2015.01); *Y10T 24/4093* (2015.01)

(58) Field of Classification Search

CPC ..... A44B 11/125; A44B 11/02; A44B 11/10; A42B 3/08; Y10T 24/2185; Y10T 24/21; Y10T 24/4019; Y10T 24/4084; Y10T 24/4086; Y10T 24/4093

USPC ..... 2/421

See application file for complete search history.

(56) References Cited

U.S. PATENT DOCUMENTS 804,397 A * 11/1905 Grushus ..... B68C 1/16 24/170
1,704,261 A * 3/1929 Russ ..... A44B 11/02 24/184
2,981,993 A * 5/1961 Elsner ..... A44B 11/12 24/170
3,163,905 A * 1/1965 Gaylord ..... A44B 11/10 24/196
3,165,802 A * 1/1965 Irvin ..... A44B 11/2526 24/197
3,192,587 A * 7/1965 White ..... A44B 11/04 24/200
3,203,064 A * 8/1965 Murphy, Sr. ..... A44B 11/2511 24/196
3,231,953 A * 2/1966 McHenry ..... A44B 11/2526 24/197
3,344,486 A * 10/1967 Eveland ..... A44B 11/08 24/171
3,686,715 A * 8/1972 Brodnicki ..... A44B 11/125 24/170
3,703,024 A * 11/1972 Johnson ..... A44B 11/12 24/196
3,893,210 A * 7/1975 Hildebrandt ..... A44B 11/125 24/171
3,950,826 A * 4/1976 Knoll ..... A44B 11/10 24/171
3,975,800 A * 8/1976 Farlind ..... A44B 11/2557 24/196
4,044,400 A * 8/1977 Lewicki ..... A42B 3/08 2/421
4,102,018 A * 7/1978 Kawahara ..... A44B 11/125 24/68 CD
4,118,833 A * 10/1978 Knox ..... A44B 11/125 24/68 CD (Continued)

FOREIGN PATENT DOCUMENTS

EP 1698244 A2 9/2006
RU 2019110 C1 9/1994
WO 2006/089098 A1 8/2006

*Primary Examiner* — Anna Kinsaul
*Assistant Examiner* — Jocelyn Wu
(74) *Attorney, Agent, or Firm* — Booth Udall Fuller, PLC

(57) ABSTRACT

A webbing adjuster for maintaining orderly, adjustable strap arrangement and secure connections in, e.g., a helmet, which allows for strap adjustment and, upon cinching, secures straps in place. The adjuster can be used in mountaineering, with motorcycle and bicycle helmets, and in other applications that benefit from orderly, adjustable strap arrangement and/or secure connections.

16 Claims, 10 Drawing Sheets

(56) References Cited

U.S. PATENT DOCUMENTS 4,131,976 A * 1/1979 Bengtsson ..... A44B 11/10 24/196
4,171,555 A * 10/1979 Bakker ..... A44B 11/04 24/200
4,386,452 A * 6/1983 Stephenson ..... A44B 11/10 24/171
4,395,803 A * 8/1983 Krauss ..... A44B 11/04 24/200
4,480,854 A * 11/1984 Doty ..... A44B 11/10 24/171
4,493,135 A * 1/1985 Crook, Jr. ..... A44B 11/04 24/193
4,551,889 A * 11/1985 Narayan ..... A44B 11/10 24/171
4,608,735 A * 9/1986 Kasai ..... A44B 11/10 24/171
4,637,099 A * 1/1987 Kasai ..... A44B 11/04 24/169
4,791,709 A * 12/1988 Fildan ..... A44B 11/08 24/171
4,796,336 A * 1/1989 Scully ..... A44B 11/125 24/196
4,810,036 A * 3/1989 Buser ..... A44B 11/02 24/265 AL
4,843,688 A * 7/1989 Ikeda ..... A44B 11/12 24/170
4,903,378 A * 2/1990 Kasai ..... A44B 11/10 24/171
4,918,790 A * 4/1990 Cirket ..... A44B 11/006 24/442
5,050,274 A * 9/1991 Staniszewski ..... A44B 11/10 24/171
5,088,160 A * 2/1992 Warrick ..... A44B 11/10 24/171
5,123,121 A * 6/1992 Broersma ..... A42B 3/066 2/421
5,243,741 A * 9/1993 Fudaki ..... A44B 11/04 24/197
5,307,542 A * 5/1994 Murai ..... A44B 11/04 24/169
5,309,606 A * 5/1994 Kawamura ..... A44B 11/10 24/171
5,311,653 A * 5/1994 Merrick ..... A44B 11/10 24/171
5,331,726 A * 7/1994 Suh ..... A44B 11/10 24/196
5,351,341 A * 10/1994 Broersma ..... A42B 3/066 2/412
5,584,106 A 12/1996 Anscher
5,600,875 A * 2/1997 Chang ..... A44B 11/02 24/163 R
5,651,166 A * 7/1997 Lundstedt ..... A44B 11/04 24/196
5,666,700 A 9/1997 Anscher et al.
5,774,947 A * 7/1998 Anscher ..... A44B 11/06 24/171
5,920,963 A * 7/1999 Chou ..... F16G 11/10 24/170
5,991,986 A * 11/1999 Canna ..... A44B 11/006 24/197
6,085,357 A 7/2000 Broersma
6,230,370 B1 * 5/2001 Nelsen ..... A44B 11/125 24/68 CD
6,665,913 B2 * 12/2003 Kosh ..... A44B 11/12 24/170
6,735,826 B2 * 5/2004 Uehara ..... A44B 11/12 24/170
6,868,587 B2 * 3/2005 Rard ..... A44B 11/125 24/170
7,004,695 B1 * 2/2006 Wen-Hsiang ..... A44B 11/125 410/100
7,150,079 B2 * 12/2006 Lundstedt ..... F16G 11/10 24/129 R
7,203,972 B2 4/2007 Pietrzak et al.
7,404,239 B1 * 7/2008 Walton ..... A44B 11/12 24/170
7,874,049 B2 * 1/2011 Paik ..... A44B 11/263 24/170
8,327,507 B2 * 12/2012 Eisinger ..... B60N 2/2812 24/168
8,464,402 B2 * 6/2013 Mamie ..... B60P 7/0823 24/170
8,635,746 B2 * 1/2014 Bellamy ..... A61B 17/1327 24/170
8,840,145 B2 * 9/2014 Bougher ..... A44B 11/2561 24/171
9,149,091 B2 * 10/2015 Ishii ..... A44B 11/12
2004/0055077 A1 3/2004 Wright
2005/0086772 A1 * 4/2005 Yoshiguchi ..... A44B 11/04 24/197
2006/0248690 A1 * 11/2006 Yazzie, Sr. ..... A44B 11/10 24/197
2007/0022577 A1 * 2/2007 Funo ..... A44B 11/04 24/196
2007/0226961 A1 * 10/2007 Anderson ..... A44B 11/2588 24/170
2008/0078069 A1 * 4/2008 Pontaoe ..... A44B 11/04 24/196
2010/0125980 A1 * 5/2010 Hede ..... A44B 11/18 24/163 R
2010/0242232 A1 * 9/2010 Wolner ..... A62B 35/0031 24/166
2010/0242233 A1 * 9/2010 Wolner ..... A62B 35/0031 24/197
2012/0054989 A1 * 3/2012 Eisinger ..... B60N 2/2812 24/168
2012/0198664 A1 * 8/2012 Kolasa ..... F16B 2/185 24/498
2012/0203153 A1 * 8/2012 Ng ..... A43C 11/148 602/5
2013/0000016 A1 1/2013 Hall et al.
2013/0291344 A1 * 11/2013 Hortnagl ..... A44B 11/10 24/196
2013/0341994 A1 * 12/2013 Boughner ..... A44B 11/2561 297/468
2014/0018807 A1 * 1/2014 Foerster ..... A61B 17/82 606/74
2014/0033485 A1 * 2/2014 Kingery ..... B66D 3/04 24/68 R
2014/0096310 A1 * 4/2014 Szalkowski ..... A42B 3/08 2/411
2015/0237972 A1 * 8/2015 Kolasa ..... A44B 11/26 24/197
2015/0250248 A1 * 9/2015 Jacobsen ..... A42B 3/12 2/421

* cited by examiner

SELF-ACTUATING WEBBING ADJUSTER AND HELMET STRAP SYSTEM INCLUDING SAME

FIELD OF THE INVENTION

The present invention generally relates to the field of webbing adjustment. In particular, the present invention is directed to a self-actuating webbing adjuster, and a protective helmet strap system employing same.

BACKGROUND

Webbing adjusters have been used in mountaineering, motorcycle and bicycle helmets, and other applications that benefit from orderly, adjustable strap arrangements and/or secure connections. Many different strap arrangements, buckles and adjusters are employed in different types of helmets.

Bicycle helmets in particular often have strap arrangements that are inconvenient or difficult to adjust. Bicycle helmet strap arrangements commonly involve two straps on each side of the helmet. The straps on each side are typically mounted to anchor points at the front and rear of the helmet, fed together through a webbing adjuster and attached to a buckle. The two straps are brought together through the buckle for added security and strength.

One function of a webbing adjuster is to adjust the fore and aft position of the straps so that the helmet sits properly on different wearer's heads. Since, in a conventional arrangement, separate straps are attached to different points on the helmet and fed through a single adjuster, the portions of the straps between the helmet anchor points and the adjustor can become twisted. Twisted straps can make the helmet difficult to adjust and may lead to undesirable effects such as additional aerodynamic drag, wind noise, and/or jammed adjusters. Conventional webbing adjusters are also frequently difficult to adjust because the separate fore and aft straps are cinched together to form the chin strap, thus terminating in a buckle.

Another challenge in the design of bicycle helmets is consideration of various safety standards such as European Standard EN 1078:201 or the CPSC Safety Standard For Bicycle Helmets (16 CFR Part 1203) in the United States. Among other things, these standards set requirements for design and testing of qualifying products, and thus may limit design choices available to persons of ordinary skill in the design of helmets and helmet retention systems.

SUMMARY OF THE DISCLOSURE

Embodiments of the present invention variously address the issue of undesirable strap arrangement. In exemplary embodiments, the invention provides orderly, adjustable strap arrangement and secure connections for bicycle helmet straps.

In one implementation, the present disclosure is directed to a webbing adjuster selectively positionable and securable on a bight of webbing, the webbing having a width and a thickness. The adjuster includes a strap securing component comprising opposed sidewalls with a securing beam extending lengthwise between the sidewalls, the securing beam having a height in a direction perpendicular to the lengthwise direction; and a strap guiding component movably received between the sidewalls adjacent the securing beam, the strap guiding component defining at least a first opening with a width sufficient to receive a width of webbing and a height sufficient to receive at least two thicknesses of webbing; wherein the securing beam height is greater than the first opening height and the strap securing and guiding components are configured and dimensioned to slidably receive the bight of webbing around the securing beam and through the at least one opening, and to trap the bight of webbing between the securing beam and strap guiding component in response to a force applied to the strap guiding component when tensioned in a direction opposite the bight of webbing.

In another implementation, the present disclosure is directed to a helmet strap system. The system includes a first helmet strap adapted to be secured at fore and aft positions on a helmet forming a bight therebetween, the strap having a width and a thickness; a strap securing component comprising opposed sidewalls with a securing beam extending lengthwise between the sidewalls; a strap guiding component movably received between the sidewalls adjacent the securing beam, the strap guiding component defining at least one opening with a height and a width sufficient to receive therethrough the bight of the first helmet strap, the bight passing through the at least one opening and around the securing beam; and a chin strap looped through the at least one opening in the strap guiding component in a direction away from the bight of helmet strap; wherein (i) the securing beam and strap guiding component trap the helmet strap bight therebetween when the chin strap is tensioned away from the helmet strap bight, and (ii) the securing component and the strap guiding component are slideable on the helmet strap bight when untensioned.

In still another implementation, the present disclosure is directed to a method of adjusting a helmet strap system wherein the system includes at least one helmet strap configured to be anchored at fore and aft positions on a helmet forming a bight of webbing there between, a webbing adjuster slidable on the at least one helmet strap, and a chin strap secured to the webbing adjuster. The method includes positioning the webbing adjuster at a desired position on the at least one helmet strap by sliding the adjuster along the helmet strap, and securing the webbing adjuster at the desired position by trapping the helmet strap between cooperating parts of the webbing adjuster in response to tension applied to the chin strap in a direction away from the helmet strap and webbing adjuster.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Embodiments of the present invention overcome disadvantages of conventional webbing adjusters, such as aerodynamic drag, wind noise, and jammed adjusters associated with twisted helmet straps by, inter alia, mounting a strap of webbing between anchor points at the front and rear of each lateral side of a bicycle helmet, folding the strap back on itself to form a bight received in an upper portion of a self-actuating webbing adjuster and mounting a second strap of webbing to a lower portion thereof to form, for example, a chin strap. Advantageously, embodiments of the invention provide users of the invention with the ability to slide the self-actuating webbing adjuster ventrally and dorsally (i.e., forward and backward or fore and aft) as desired for maximum comfort when the chin strap is untensioned while maintaining the helmet straps in a flat and ordered arrangement.

Figure 1:
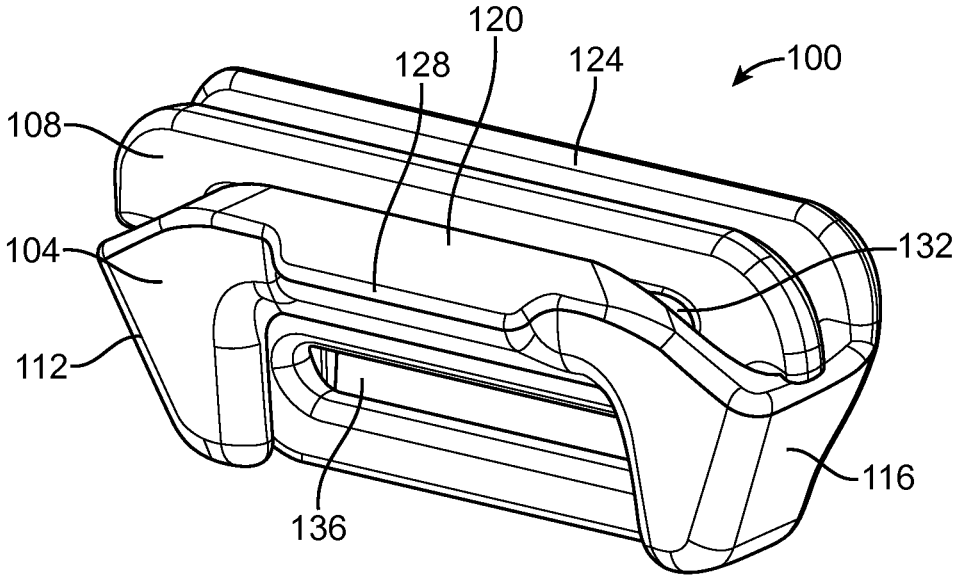
FIG. 1 is a perspective view of a self-actuating webbing adjuster according to an exemplary embodiment of the invention.
Figure 2:
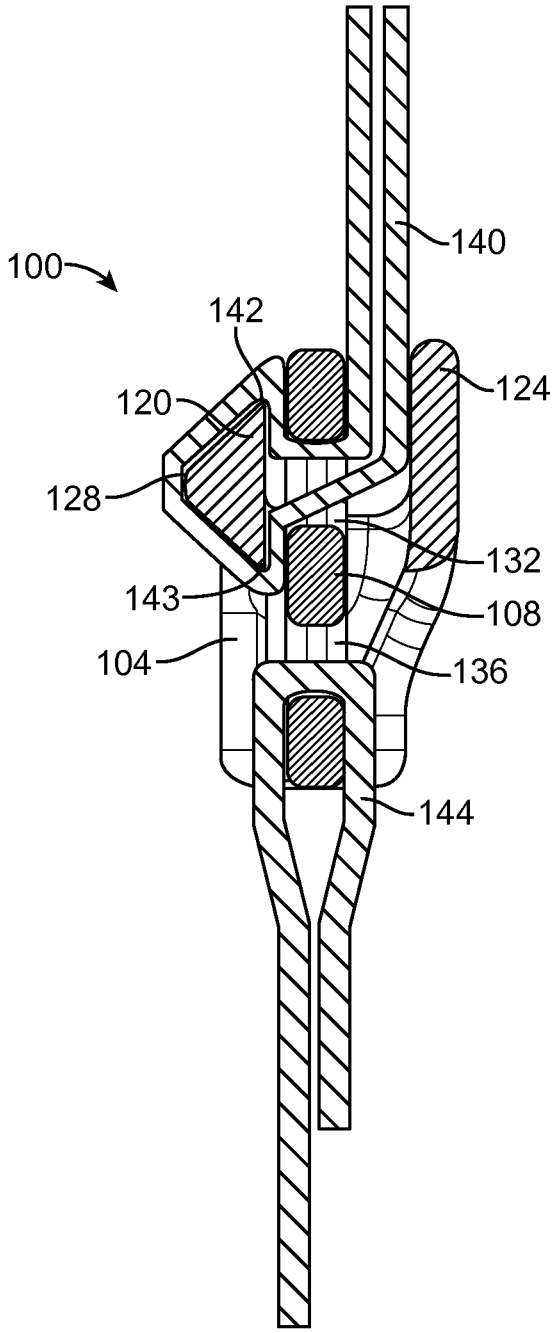
FIG. 2 is a cross-sectional view of a self-actuating webbing adjuster according to an exemplary embodiment of the invention.
Figure 4:
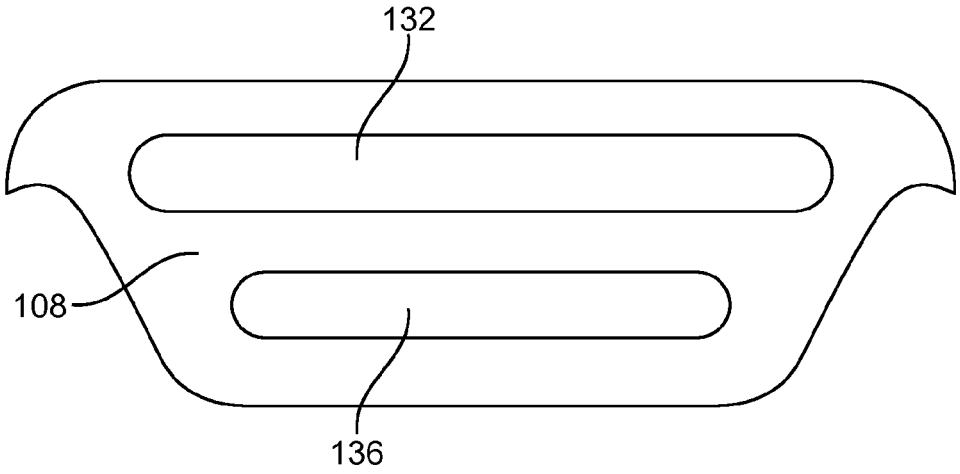
FIG. 4 is a plan view of a strap guiding component of a self-actuating webbing adjuster according to an exemplary embodiment of the invention as shown in FIGS. 1 and 2.
Figure 5A:
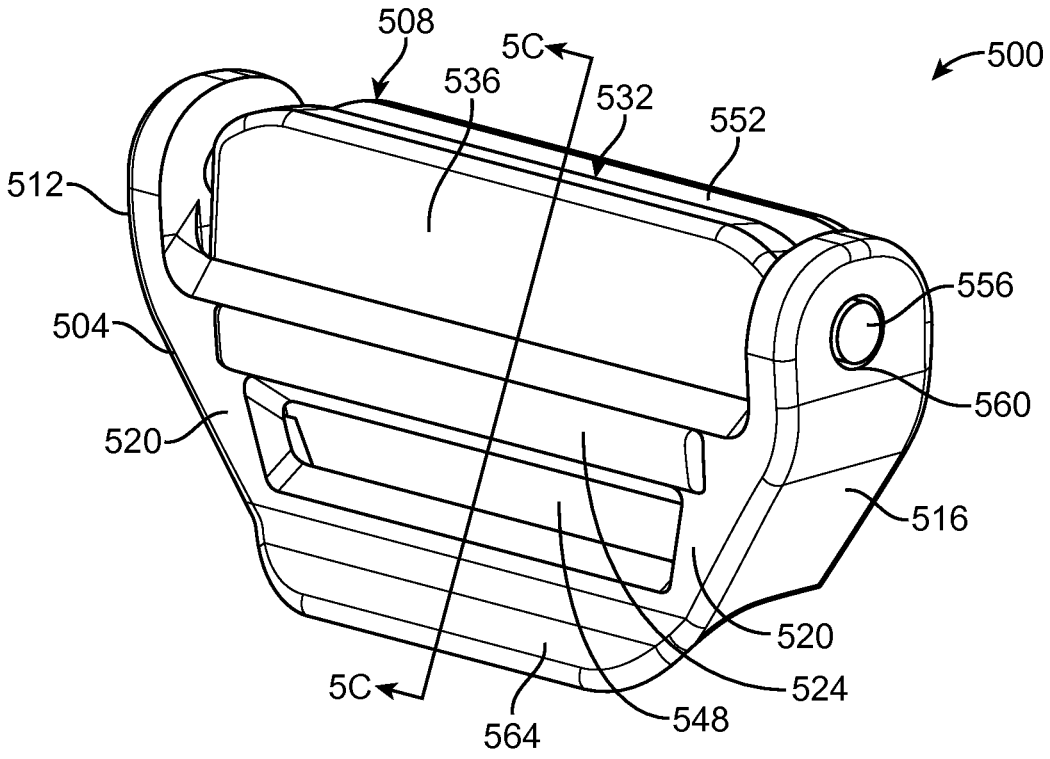
FIGS. 5A-D are various perspective views of a self-actuating webbing adjuster according to another exemplary embodiment of the invention.
Figure 5B:
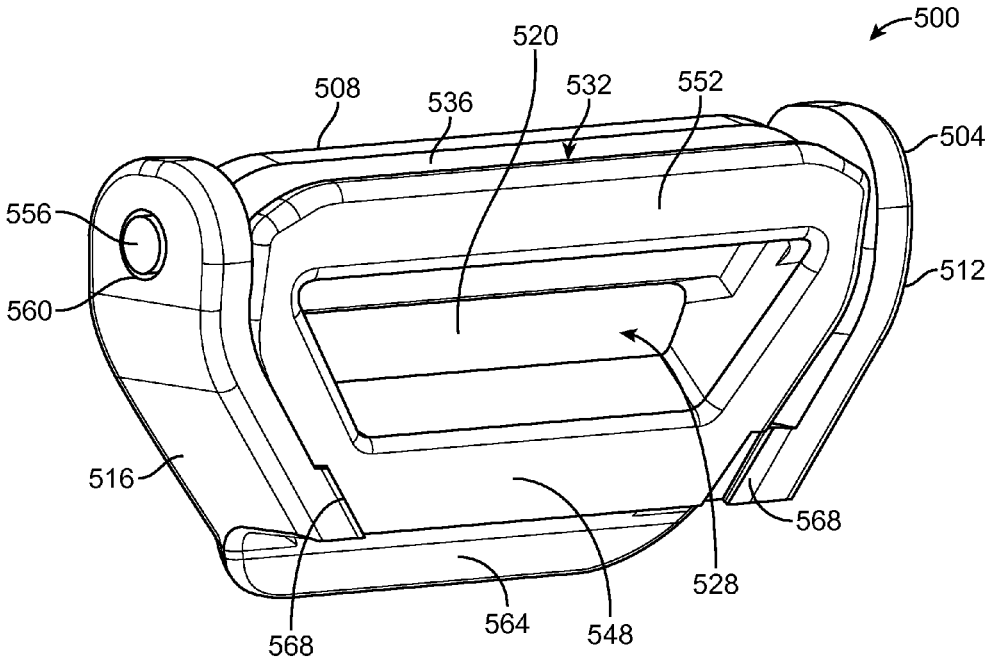
Figure 5C:
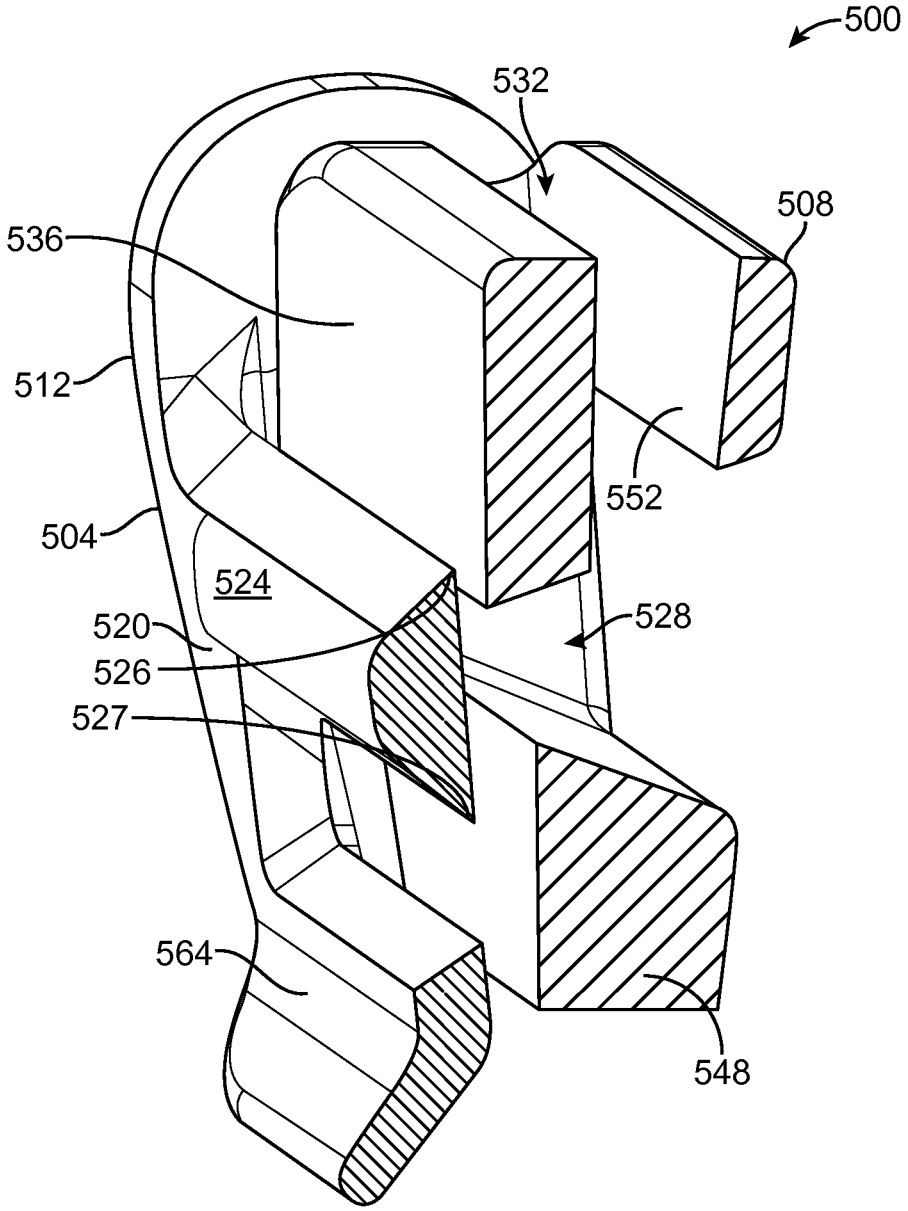
Figure 5D:
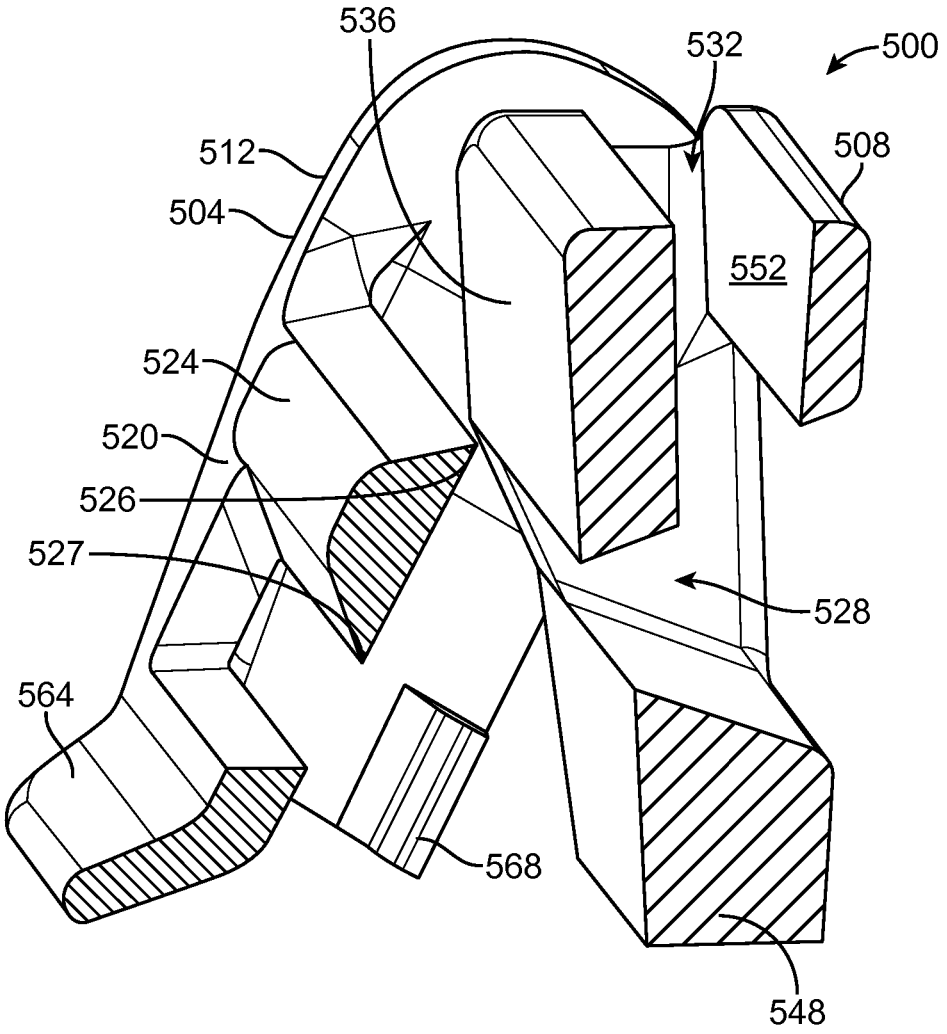

In one exemplary embodiment, a self-actuating webbing adjuster 100 according to the invention may comprise a strap securing component 104 and a strap guiding component 108, as shown, for example, in FIGS. 1, 2, and 4. Strap securing component 104 may comprise a housing or sleeve-like member with opposed lateral sidewalls 112, 116 and opposed medial sidewalls 120, 124. In one embodiment, the lateral sidewalls are disposed in a lower portion of the strap securing component and the medial sidewalls in an upper portion. Securing component 104 also may define an open center between the sidewalls and form notch-like openings in or below medial sidewalls 120, 124 between lateral sidewalls 112, 116 as well as in or above lateral sidewalls 112, 116 between medial sidewalls 120, 124. One sidewall, for example, sidewall 120 in FIGS. 1 and 2, may be formed as a strap securing beam. The securing beam will have at least a height and/or stiffness sufficient to prevent it from deforming into the aligned opening of the strap guiding component (e.g., slit 132 of guiding component 108 in one embodiment) when the helmet and chin straps are tensioned up to a maximum intended design load. Other securing features may be included on or as part of the securing beam, such as one or more sharp edges, angled or shaped surfaces, protrusions and/or other suitable strap engaging features to assist in securing a strap against sliding when guided in place and trapped by cooperation between the strap securing and strap guiding components as discussed below.

Figure 3:
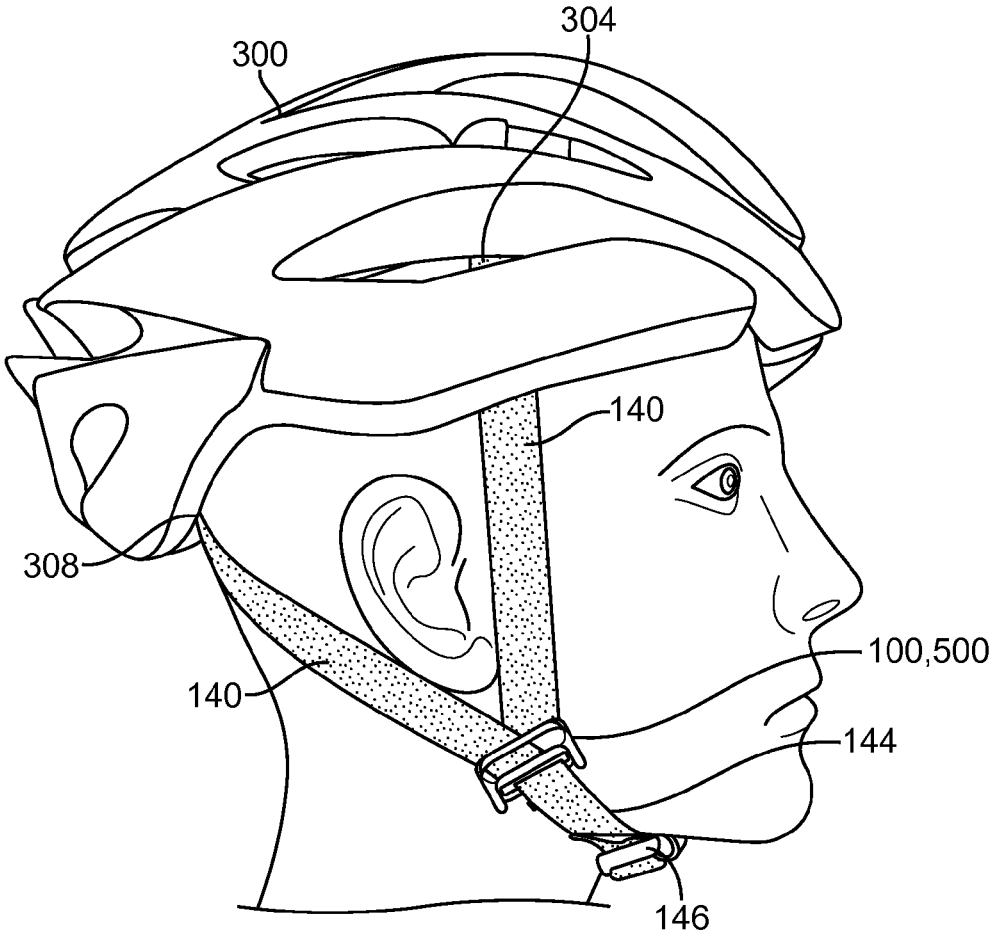
FIG. 3 is a side view of a helmet strap system including a self-actuating webbing adjuster according to exemplary embodiments of the invention.

As shown in FIGS. 1 and 2, the securing beam 120 may include a protrusion 128, which may provide a substantially triangular or trapezoidal shape to the cross-section of the securing beam. In alternative embodiments, protrusion 128 may have any other suitable shape including angled edges to engage webbing wrapped therearound. To assist in properly positioning the helmet strap on the wearer's head, the interior surfaces of lateral sidewalls 112, 116 may be angled with respect to one another at about 50 to about 80 degrees, or more preferably at about 60 to about 70 degrees. This angled arrangement will facilitate positioning of the helmet strap 140 in a configuration generally as shown in FIG. 3. The interior surfaces of medial sidewalls 120, 124 may be substantially flat and parallel with one another. Securing component 104 may be made of nylon in an exemplary embodiment, though any other suitably durable and corrosion-resistant polymer, metal, material, or coated material may be used. In some cases, as will be appreciated by persons of ordinary skill in the art, stiffening materials such as glass or carbon fiber may be added to increase the stiffness of the securing beam.

A strap guiding component 108 according to an embodiment of the invention may comprise a relatively thin, flat and somewhat mushroom-shaped member as shown in FIG. 4. The guiding component may be shaped and sized such that it can be received within the open center defined by securing component 104, thus the angle of the outer lateral edges will at least approximately match the angle of the interior surfaces of lateral sidewalls 112, 116 of the securing component. In an exemplary embodiment, guiding component 108 extending over each of the lateral sidewalls 112, 116, as seen in FIG. 1. In an exemplary embodiment, guiding component 108 may have two slits 132, 136 formed medially therethrough, one above the other. In alternative embodiments, a single slit may be used. The distance between the medial sidewalls 120, 124 of securing component 104 may have a thickness about equal to the combined thickness of three straps and strap guiding component 108. Guiding component 108 may be fabricated from nylon in an exemplary embodiment, though any other suitably durable and corrosion-resistant polymer, metal, material, or coated material may be used, as well as stiffening materials as mentioned above.

In one exemplary embodiment, for use with nylon or nylon/polyester webbing with a width of about 16 mm and thickness of about 0.7 mm, strap guiding component 108 may comprise the following relative dimensions: overall width—32 mm; overall height—12 mm; overall thickness —1.5 mm; slit 132 width—22.5 mm; slit 132 height—2 mm, slit 136 width—16 mm; slit 136 height —1.8 mm. Strap securing component 104 will have complimentary dimensions. It is emphasized, however, that these relative dimensions are not required to practice the invention. For example, different relative slit thicknesses may be required based on the material(s) and/or thickness(es) of straps used; other dimensions may also be varied within the scope of the invention.

A helmet strap system according to embodiments of the invention is illustrated in FIG. 3. On each lateral side of helmet 300, a strap 140, sometimes referred to as a "helmet strap," is attached to a front helmet anchor 304 and a rear helmet anchor 308, thus forming a bight in the strap between the two anchor points. The two ends of the bight lay flat against each other and the bight is received through guiding component 108 and around a securing beam, for example, wall 120 of securing component 104, as illustrated in FIG. 2 (or FIG. 6A). As will be apparent to persons of ordinary skill in the art, if strap 140 is to be permanently fixed at anchor helmet anchors 304 and 308, then the strap may be threaded through the adjuster as part of the helmet manufacturing process prior to provision of the helmet to an end user.

In an exemplary embodiment as shown in FIGS. 1 and 2, strap 140 is passed through upper slot 132 of guiding component 108 and around trapezoidal protrusion 128 of sidewall 120 and its upper and lower sharp edges 142, 143. The strap is then fed back through the slit 132, out of the self-actuating webbing adjuster 100, and anchored to a helmet anchor 304 or 308. A separate strap 144, sometimes referred to as a "chin strap," may be fed through the lower slit 136 and may be secured using a bar-tack, over-molding with the adjuster, or any other suitable securing means. Chin strap 144 may be provided with a user openable connector or buckle 146 as known in the art. In an alternative embodiment, guiding component 108 may only have a single slit (see, e.g., FIGS. 6A-B) that receives both helmet strap 140 and chin strap 144.

While self-actuating webbing adjuster 100 is in a non-actuated, or unsecured state, strap guiding component 108 may move relative to strap securing component 104. In this arrangement, the self-actuating webbing adjuster can slide freely anteriorly and posteriorly (forward and backward or fore and aft) along helmet strap 140. However, when chin strap 144 pulls down on guiding component 108, force is applied to helmet strap 140 causing it to forcibly engage the securing beam, thus trapping the helmet strap between securing beam 120 and guiding component 108 and securing the fore and aft position of webbing adjuster 100 on helmet strap 140. As such, the self-actuating webbing adjuster is secured in response to tension applied to the chin strap, but allows for ease of adjustment of the fore and aft positioning when the chin strap is untensioned, such as by unbuckling. In this arrangement, helmet strap 140 also tends to lay flat against the wearer's head regardless of the positioning of the webbing adjuster.

In another exemplary embodiment, a self-actuating webbing adjuster 500 may comprise a strap securing component 504 and a strap guiding component 508, as shown for example in FIGS. 5A-D and 6A-B. Securing component 504 may comprise opposed lateral sidewalls 512, 516 with a medial sidewall 520 on one side. In this embodiment, medial sidewall 520 forms the securing beam, which is generally configured in the same manner and with the same materials as the securing beam in the embodiment of FIGS. 1 and 2. Medial sidewall 520 may have a trapezoidal protrusion 524, which may have a substantially triangular or trapezoidal shape and upper and lower sharp edges 526, 527 (see, cross-section in FIGS. 5C-D and 6A-B). In alternative embodiments, trapezoidal protrusion 524 may have other suitable shapes including angled edges capable of further engaging webbing wrapped therearound.

Strap guiding component 508 may comprise three elongate members connected at their ends and may be shaped and sized such that it fits at least partially between the sidewalls of securing component 504. When three elongate members are employed, two slits will be formed: horizontal slit 528 and vertical slit 532. Horizontal slit 528 is a space between elongate member 536 and a lower elongate member 548. Vertical slit 532 is a space between elongate member 536 and elongate member 552, which may be considered as forming a medial sidewall of guiding component 508. Pivots 556 may extend laterally from elongate member 536 and rotatably interface with corresponding bores 560 in lateral sidewalls 512, 516 of securing component 504. Strap securing component 504 may further include a grip 564 and retaining members 568 to facilitate operation as described further below. Both components 504 and 508 may be fabricated from nylon in an exemplary embodiment, though any other suitably durable and corrosion-resistant polymer or metal materials or coated materials may be used.

In an exemplary embodiment, for use with nylon or nylon/polyester webbing with a width of about 16 mm and thickness of about 0.7 mm, strap guiding component 508 may comprise the following relative dimensions: overall width—30 mm; overall height—16 mm; slit 528 width—18 mm; slit 528 height—2.2 mm, slit 532 width—25 mm; slit 532 height—2.2 mm. Strap securing component 504 will have complimentary dimensions. It is emphasized, however, that these relative dimensions are not required to practice the invention. For example, as with strap guiding component 108, different relative slit thicknesses may be required based on the material(s) and/or thickness(es) of straps used; other dimensions may also be varied within the scope of the invention.

With reference again to FIG. 3, adjuster 500 operates in a manner similar to adjuster 100. Thus, only different features of adjuster 500 are mentioned herein below. Helmet strap 140 may be fed from front helmet anchor 304 through vertical slit 532 of strap guiding component 508 (see FIG. 6A), through horizontal slit 528, around trapezoidal protrusion 524 of medial sidewall 520 of housing 504, back through horizontal slit 528 and vertical slit 532 of the strap guiding component 508, out of self-actuating webbing adjuster 500, and anchored to rear helmet anchor 308. Helmet strap 140 may also be fed through the adjuster in the opposite direction. Chin strap 144 may be fed through the horizontal slit 528 and may be secured using a bar-tack, over-molding with the adjuster, or any other suitable securing means as previously described.

Figure 6A:
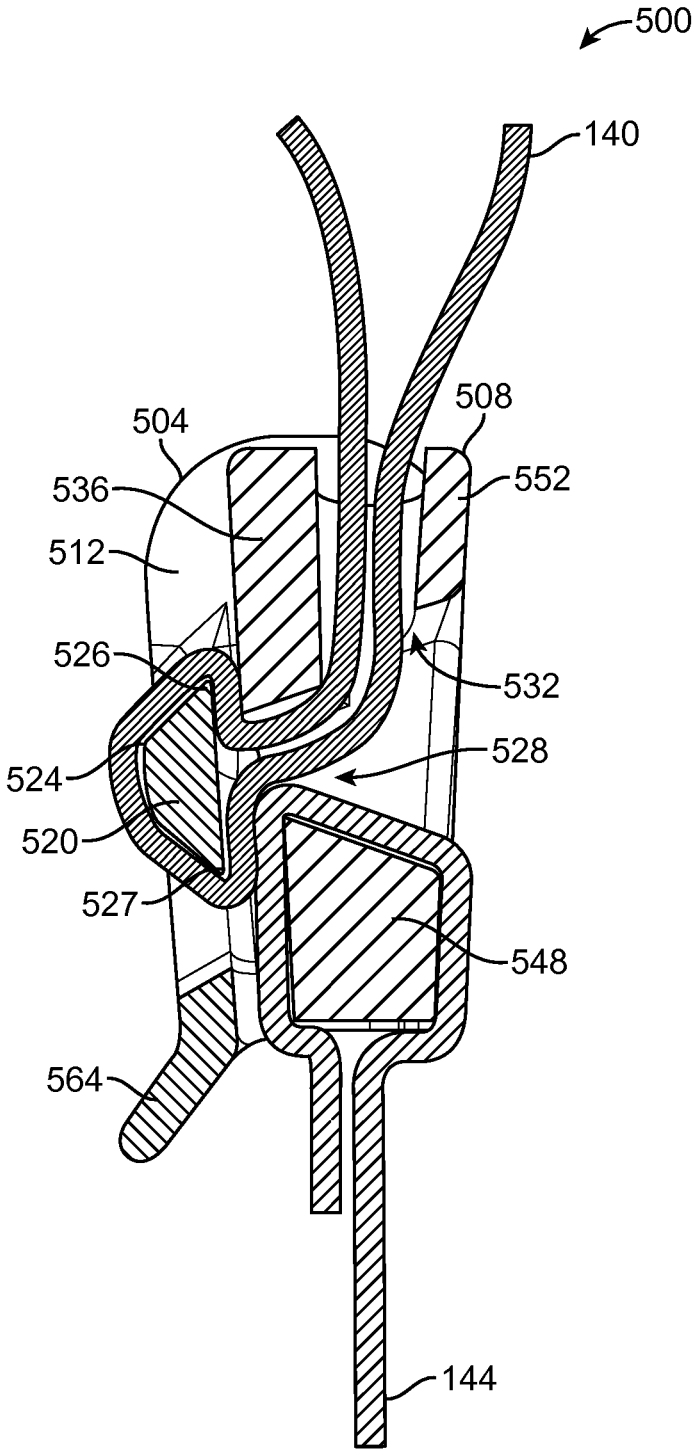
FIGS. 6A-B are cross-sectioned views of a self-actuating webbing adjuster according to an exemplary embodiment of the invention as shown in FIGS. 5A-D.
Figure 6B:
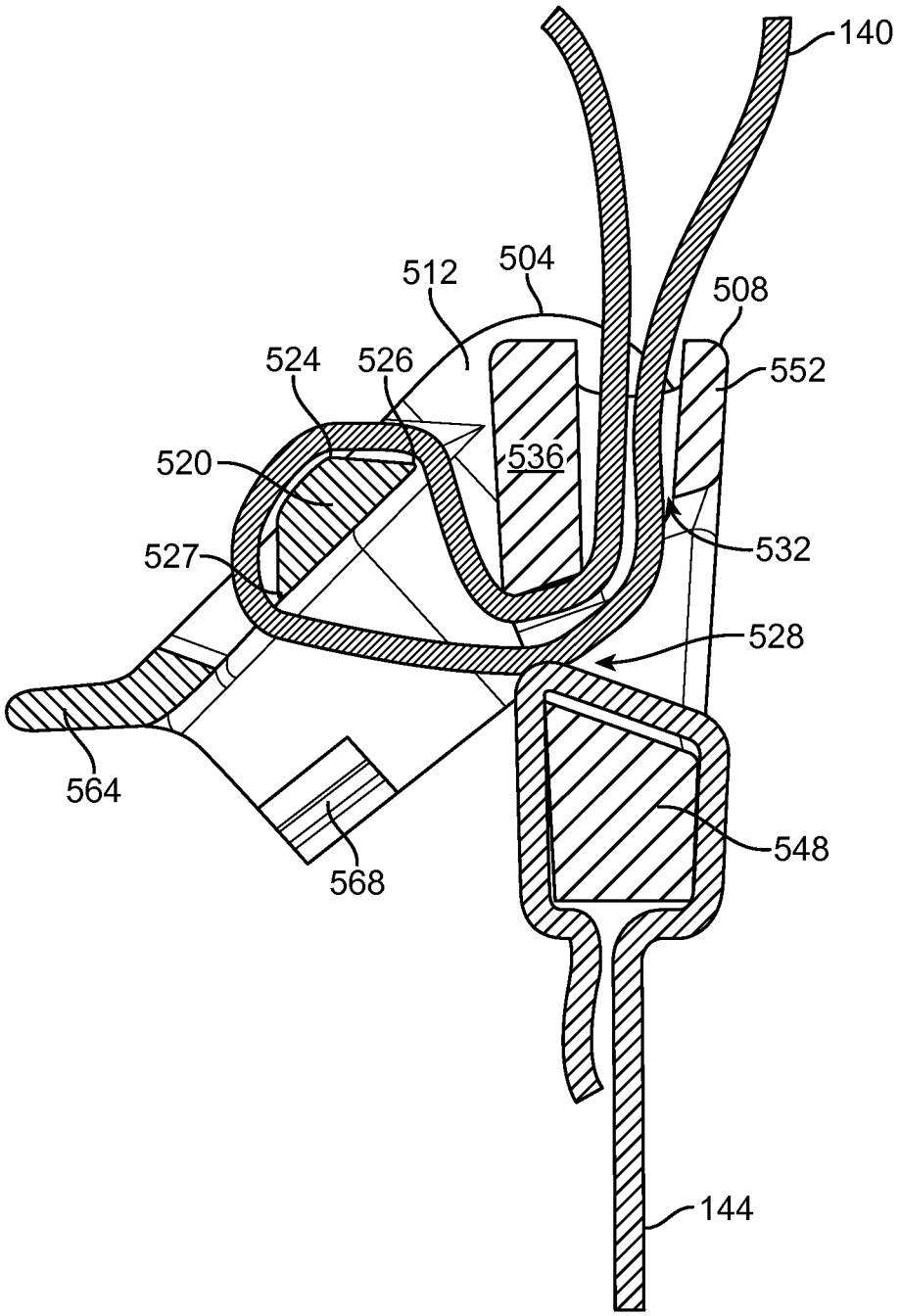

While self-actuating webbing adjuster 500 is in an unsecured state, such as is shown in FIG. 6B, helmet strap 140 can slide relatively freely there through. When self-actuating webbing adjuster 500 is in a secured state, such as is shown in FIGS. 5A-C and 6A, with chin strap 144 exerting a downwards force, helmet strap 140 is trapped and secured by the cooperation of components 504 and 508.

In an exemplary, non-limiting embodiment, when the self-actuating webbing adjuster 500 is in a secured state, such as is shown in FIG. 6A, the opening between the lower elongate member 548 of strap guiding component 508 and the medial sidewall 520 of the housing 504 may have a thickness about equal to the combined thickness of two straps and the opening between elongate member 536 of strap guiding component 508 and the medial sidewall 520 of the housing 504 may have a thickness about equal to the thickness of one strap (see FIG. 6A).

In a further exemplary embodiment, angularly protruding grip 564 may be used to move strap securing component 504 towards or away from guiding component 508 to secure (FIGS. 5A-C and 6A) and unsecure (FIGS. 5D and 6B), respectively, self-actuating webbing adjuster 500. Retaining members 568 maintain the secured position by resisting movement through cooperative engagement with guiding component 508. Though shown in FIGS. 5B, 5D, and 6B as protrusions or tab-like structures, retaining members 568 may be implemented by any suitable retaining means known in the art, for example, as detents.

Further advantages, including decreased cost and increased manufacturing speed, may be realized by aspects of the invention. Due to its particular two-piece arrangement, a self-actuating webbing adjuster according to the invention allows for simple strap threading. Since conventional adjusters had to have their associated straps threaded through difficult turns and narrow slots during helmet assembly, the self-actuating webbing adjuster 100 may increase manufacturing speed and reduce materials as compared to conventional adjusters.

Though described primarily in the context of bicycle helmets, after reviewing this disclosure in its entirety, one of ordinary skill in the art will recognize that a self-actuating webbing adjuster made according to the invention can be used in mountaineering scenarios, with motorcycle helmets, or in any other applications that benefit from orderly, adjustable strap arrangement and/or secure connections.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

The invention claimed is:

1. A webbing adjuster selectively positionable and securable on a bight of webbing, the webbing having a width and a thickness: the adjuster comprising:

a strap securing component comprising opposed sidewalls with a securing beam extending lengthwise between the sidewalls, the securing beam having a height in a direction perpendicular to the lengthwise direction, wherein the strap securing component further comprises an open center defined by the opposed sidewalls and the securing beam; and a strap guiding component received in the open center of the strap securing component between the sidewalls adjacent the securing beam, a top portion of the strap guiding component extending over each of the opposed sidewalls; the strap guiding component comprising at least a first opening formed medially through the strap guiding component, the first opening comprising a width sufficient to receive a width of webbing and a height sufficient to receive at least two thicknesses of webbing;

wherein the securing beam height is greater than the first opening height, and the strap securing and guiding components are configured and dimensioned to slidably receive the bight of webbing around the securing beam and through the first opening; and wherein the strap guiding component is moveable between a raised position and a lowered position relative to the strap securing component, such that in a lowered position, the strap guiding component traps the bight of webbing between the securing beam and strap guiding component in response to a force applied to the strap guiding component when tensioned in a direction opposite the bight of webbing.

2. The webbing adjuster according to claim 1, wherein said strap guiding component defines at least a second opening below said first opening, said second opening having sufficient width and height to receive one thickness of webbing.

3. The webbing adjuster according to claim 1, wherein the securing beam does not deform into the first opening in response to tensioning of the strap guiding component away from the bight of webbing.

4. The webbing adjuster according to claim 3, wherein the securing beam comprises at least one longitudinally directed sharp edge for engaging the bight of webbing.

5. The webbing adjuster according to claim 3, wherein the securing beam has a trapezoidal cross section.

6. The webbing adjuster according to claim 3, wherein the securing beam has at least one protrusion configured to engage the bight of webbing.

7. A helmet strap system, comprising:

a first helmet strap adapted to be secured at fore and aft positions on a helmet forming a bight therethrough, the strap having a width and a thickness;

a strap securing component comprising opposed sidewalls with a securing beam extending lengthwise between the sidewalls;

a strap guiding component received between the sidewalls adjacent the securing beam, a top portion of the strap guiding component extending over each of the opposed sidewalls; the strap guiding component defining at least one opening with a height and a width sufficient to receive therethrough the bight of the first helmet strap, a single thickness of the strap passing around the securing beam and two thicknesses of the strap passing through the at least one opening of the strap guiding component; and a chin strap looped through the at least one opening in the strap guiding component in a direction away from the bight of the first helmet strap;

wherein the strap guiding component is moveable between a raised position and a lowered position relative to the strap securing component, such that in the lowered position, the strap guiding component traps the helmet strap bight between the securing beam and strap guiding component when the chin strap is tensioned away from the helmet strap bight, and in the raised position, the strap securing component and the strap guiding component are slidable along the helmet strap bight.

8. The helmet strap system according to claim 7, wherein the strap guiding component is designed and configured to slide between sidewalls relative to securing beam.

9. The helmet strap system according to claim 7, wherein the strap guiding component has at least two openings with a first opening having a height sufficient to receive two thicknesses of helmet strap and a second opening having a height sufficient to receive one thickness of chin strap, the bight of helmet strap being passed through the first opening and the chin strap being secured in a loop through the second opening.

10. The helmet strap system according to claim 7, wherein the securing beam does not deform into the at least one opening in response to tensioning of the chin strap up to maximum design load.

11. The helmet strap system according to claim 10, wherein the securing beam height is greater than at least one opening height.

12. The helmet strap system according to claim 7, wherein the securing beam comprises at least one longitudinally directed sharp edge for engaging the helmet strap bight.

13. The helmet strap system according to claim 7, wherein the securing beam has a trapezoidal cross section.

14. The helmet strap system according to claim 7, wherein the securing beam includes at least one protrusion configured to engage the helmet strap bight.

15. The helmet strap system according to claim 7, further comprising:

a second helmet strap adapted to be secured at fore and aft positions on an opposite side of the helmet from the first helmet strap; and a second strap guiding component and second strap securing component positioned on the second helmet strap with a second end of the chin strap secured thereto;

wherein the chin strap comprises at least two pieces joined by a user openable connector.

16. The helmet strap system according to claim 15, further comprising the helmet secured to the helmet straps.

* * * * *